US010024196B2

(12) United States Patent
Aumann et al.

(10) Patent No.: US 10,024,196 B2
(45) Date of Patent: Jul. 17, 2018

(54) HIGH-PRESSURE SIDE SEPARATION OF LIQUID LUBRICANT FOR LUBRICATING VOLUMETRICALLY WORKING EXPANSION MACHINES

(75) Inventors: Richard Aumann, Munich (DE); Andreas Schuster, Tussenhausen (DE); Andreas Sichert, Munich (DE)

(73) Assignee: ORCAN ENERGY AG, Munich (DE)

( * ) Notice: Subject to any disclaimer, the term of this patent is extended or adjusted under 35 U.S.C. 154(b) by 352 days.

(21) Appl. No.: 14/008,058

(22) PCT Filed: Apr. 12, 2012

(86) PCT No.: PCT/EP2012/001596

§ 371 (c)(1),
(2), (4) Date: May 25, 2016

(87) PCT Pub. No.: WO2012/143104

PCT Pub. Date: Oct. 26, 2012

(65) Prior Publication Data

US 2016/0290172 A1 Oct. 6, 2016

(30) Foreign Application Priority Data

Apr. 19, 2011 (EP) ..... 11003288

(51) Int. Cl.
*F01C 21/04* (2006.01)
*F01K 13/00* (2006.01)
(Continued)

(52) U.S. Cl.
CPC ..... *F01K 13/006* (2013.01); *F01C 21/04* (2013.01); *F01K 25/06* (2013.01); *F01K 25/10* (2013.01);
(Continued)

(58) Field of Classification Search
CPC ..... F01K 13/006; F01K 25/06; F01D 25/18; F01C 21/04
See application file for complete search history.

(56) References Cited

U.S. PATENT DOCUMENTS

2009/0188253 A1* 7/2009 Smith ..... F01C 1/16 60/657

FOREIGN PATENT DOCUMENTS

| | | | |
|---|---|---|---|
| DE | 102008050137 | A1 | 4/2010 |
| JP | 2009138684 | A | 6/2009 |
| WO | 2006131759 | A2 | 12/2006 |

OTHER PUBLICATIONS

Machine translation of JP2009138684A, accessed Oct. 26, 2017.*

* cited by examiner

*Primary Examiner* — Jonathan Matthias
(74) *Attorney, Agent, or Firm* — Moore & Van Allen PLLC; Henry B. Ward, III

(57) ABSTRACT

The invention relates to a method for lubricating an expansion machine (30) in a thermodynamic cycle device, wherein the thermodynamic cycle device comprises the expansion machine, a feed pump (50), a lubricant separator (10) and a working medium containing a lubricant, and wherein the method comprises the following steps: The working medium is subjected to pressure by means of the feed pump. The pressurized working medium is delivered by the feed pump to the lubricant separator. At least part of the lubricant is separated from the working medium by means of the lubricant separator. At least part of the separated lubricant is delivered by the lubricant separator to the expansion machine. The invention further relates to a thermodynamic cycle device comprising a working medium that contains a working fluid and a lubricant, an expansion machine, a feed pump for subjecting the working medium to pressure, and a
(Continued)

lubricant separator for separating at least part of the lubricant from the working medium, wherein the cycle device is designed to deliver at least part of the separated lubricant from the lubricant separator to the expansion machine.

17 Claims, 3 Drawing Sheets

(51) Int. Cl.

| | |
|---|---|
| ***F01K 25/10*** | (2006.01) |
| ***F01K 25/06*** | (2006.01) |
| *F01C 1/02* | (2006.01) |
| *F01C 1/12* | (2006.01) |
| *F01C 1/16* | (2006.01) |
| *F01C 1/344* | (2006.01) |

(52) U.S. Cl.
CPC ..... *F01C 1/02* (2013.01); *F01C 1/12* (2013.01); *F01C 1/16* (2013.01); *F01C 1/344* (2013.01)

PRIOR ART

HIGH-PRESSURE SIDE SEPARATION OF LIQUID LUBRICANT FOR LUBRICATING VOLUMETRICALLY WORKING EXPANSION MACHINES

FIELD OF THE INVENTION

The present invention relates to volumetrically working expansion machines, and in particular to methods for lubricating same.

BACKGROUND OF THE INVENTION

The operation of expansion machines, e.g. steam turbines, and for instance with the aid of the Organic Rankine Cycle (ORC) method for the generation of electric energy using organic media, e.g. organic media having a low evaporation temperature which usually have higher evaporation pressures at same temperatures as compared with water as working medium, is known in the state of the art. ORC plants represent a realization of the Clausius Rankine Cycle in which electric energy is generated, for instance, basically through adiabatic and isobaric changes of state of a working medium. Mechanical energy is generated by the evaporation, expansion and subsequent condensation of the working medium, and is converted into electric energy. Basically, the working medium is brought to an operating pressure by a feed pump, and energy in the form of heat, which is provided by a combustion or a flow of waste heat, is supplied to the working medium in an evaporator. The working medium flows from the evaporator through a pressure pipe to an expansion machine where it is expanded to a lower pressure. Subsequently, the expanded working medium steam flows through a condenser in which a heat exchange takes place between the vaporous working medium and a cooling medium. Then, the condensed working medium is recirculated by a feed pump to the evaporator in a cycle.

One particular class of expansion machines is represented by volumetrically working expansion machines, which are also referred to as displacement expansion machines, which comprise a working chamber and work during a volume increase of this working chamber as the working medium expands. These expansion machines are realized, for instance, in the form of piston expansion machines, screw expansion machines or scroll expanders. Volumetrically working expansion machines of this type are used in particular in low performance class ORC systems (e.g. electrical power of 1 to 500 kW). As opposed to turbines, however, volumetrically working expansion machines require lubrication by means of a lubricant, in particular of the piston and the profiles (flanks) of the expansion chamber rolling upon one another, and of the rolling bearings and the gliding walls of the working chamber. Hence, it is necessary to lubricate the bearing surfaces and the contacting flanks. The use of a lubricant advantageously also leads to a sealing of the working chamber of the expansion machine, so that less steam gets lost by an overflow inside the expansion machine and the efficiency is increased. A lubrication with oil is advantageous, with oil and live steam passing the expansion machine at the same time, which necessitates a subsequent separation of the oil and the steam.

Lubrication in refrigeration engineering is easy to realize. A soluble oil is added to the working medium. At the outlet of the compression machine the oil is available in the form of finely distributed droplets in the compressed steam. The highly pressurized steam-oil spray is now passed through an oil separator where oil is separated by a cyclone and the refrigerant is discharged from the oil separator in the form of steam in the direction of the condenser. The oil is now highly pressurized and can be directly injected into the inlet area of the compression machine and transported to the bearings. The oil is entrained with the low-pressure steam, brought to a high pressure together with the steam, and can then, again, be separated in the oil separator.

The method for lubricating compressors ensued a method for the lubrication of expansion machines. In this method, oil is added to the working medium. The separation of oil and steam likewise takes place at the outlet of the expansion machine in an oil separator. As the pressure at the outlet is lower than at the inlet during the expansion, the oil has to be brought to a live steam pressure by an oil circulation pump to allow an injection of the oil into the live steam at the inlet for the lubrication of the flanks. In addition, the bearing surfaces have to be supplied with oil, too. FIG. 1 illustrates a schematic diagram of such a lubricating system according to the state of the art. A working medium is supplied by an evaporator 1 to an expansion machine 2. In the expansion machine 2 the vaporous working medium is expanded, and the released energy is converted by a generator 3 to electric energy. A lubricant, e.g. a lubricating oil, is supplied by an oil circulation pump 4 to the expansion machine 2. The lubricant serves to lubricate the bearings L and flanks F in the expansion machine. The lubricant is discharged from the expansion machine 2 together with the expanded working medium. The lubricant is contained in the expanded working medium in the form of a finely distributed oil fog and is separated from the working medium in an oil separator 5 so that the working medium is supplied from the oil separator 5 to a condenser 6 substantially free from oil. The condensed working medium is recirculated to the evaporator 1 by a feed pump 7. The recovered oil is recirculated by the oil circulation pump 4 to the expansion machine 2.

However, the lubricating system according to the state of the art has the following drawbacks. As the lubricant (lubricating oil) is separated on the low-pressure side after passing the expansion machine 2, it is required to provide the oil circulation pump 4 which, as the lubricant has to be supplied on the high-pressure side of the expansion machine 2, has to overcome the same pressure difference as the feed pump 7 that transports the working medium, which results in a great instrumentation expenditure accompanied by respective costs. Moreover, a relatively large oil separator 5 is necessary because the exhaust steam flowing out of the expansion machine 2 has a smaller density compared to the live steam supplied to the expansion machine 2, for instance, a density lower by more than one order of magnitude. This leads to a great material expenditure accompanied by respectively high costs. The large volume necessitates a large filling quantity of relatively expensive oil. Also, the separation of the lubricant from the exhaust steam of the working medium is accomplished by means of cyclone separators or baffles, always with a significant change of direction of the exhaust steam flow containing the lubricant, so that, combined with the relatively great volumes of the waste steam flow, pressure losses occur which result in a counter-pressure that acts on the expansion machine 2 and, thus, in a reduction of the efficiency of same. As the oil is present at a low pressure level, an additional pump, the oil circulation pump, has to be used.

Furthermore, the relatively large oil separator 5 has a certain inertia on account of the relatively great mass, respectively the relatively great volume of the exhaust steam, which has a disadvantageous effect when the system is started or load changes occur. Also, the lubricant injected into the live steam, the live steam generally being in a liquid state and having the temperature approximately of the exhaust steam, reduces the temperature of the live steam and the enthalpy of the live steam in an undesirable manner, and thus the achievable work.

Hence, there is a need, and the present invention is based on the object, to provide a method for lubricating volumetrically working expansion machines in which the above-mentioned problems are overcome or at least moderated.

BRIEF SUMMARY OF THE INVENTION

The above-mentioned object is solved by a method for lubricating an expansion machine in a thermodynamic cycle device, wherein the cycle device comprises the expansion machine, a feed pump, a lubricant separator and a working medium including a lubricant, and wherein the method comprises the following steps. The working medium is pressurized by the feed pump. The pressurized working medium is supplied by the feed pump to the lubricant separator. At least a portion of the lubricant is separated from the working medium by the lubricant separator. At least a portion of the separated lubricant is supplied from the lubricant separator to the expansion machine.

As opposed to the state of the art, according to the invention at least a portion of the lubricant is separated from the working medium pressurized by the feed pump. In the state of the art this separation is made from the working medium directly leaving the expansion machine. Providing an oil circulation pump is not required in the method according to the invention as the separated lubricant is provided on a high pressure level. Also, as compared with the state of the art, the size of the lubricant separator may be smaller as the lubricant is separated from the high density liquid and not from the exhaust steam. Moreover, according to the invention the live steam temperature/enthalpy is not reduced in an undesirable manner by adding a relatively cold lubricant as the separated lubricant is preferably used to lubricate the bearing of the expansion machine. Other advantages are, on the one hand, the suitable low temperature of the lubricant supplied from the lubricant separator to the expansion machine, which ensues an advantageous cooling of the bearing, and, on the other hand, the fast start-up of the thermodynamic cycle device owing to the, as compared with the state of the art, smaller liquid stock.

According to a further development the cycle device further comprises a condenser and an evaporator, and the method according to the invention further comprises the supplying of the working medium from the expansion machine to the condenser, the liquefying of the working medium by the condenser, the supplying of the liquefied working medium from the condenser to the feed pump, the supplying of the working medium depleted of the lubricant from the lubricant separator to the evaporator, the evaporating of the working medium depleted of the lubricant in the evaporator, and the supplying of the evaporated working medium to the expansion machine.

While in this further development at least a portion of the separated lubricant is supplied to lubricating points of the expansion machine, e.g. to a bearing, a portion of the lubricant remaining according to this further development in the working medium supplied to the expansion machine serves in the lubrication of parts of the working chamber of the volumetrically working expansion machine that roll upon or glide along one another (flank lubrication). In this case, the remaining portion of the lubricant has the respectively suitable temperature, meaning that the remaining lubricant is heated together with the working medium in the evaporator and, thus, does not reduce the energy content of the live steam supplied to the expansion machine.

According to another further development the cycle device may further comprise a feed container, and the step of supplying the liquefied working medium from the condenser to the feed pump may comprise the sub-steps of (i) supplying the liquefied working medium from the condenser to the feed container, and (ii) supplying the working medium from the feed container to the feed pump. In this way a collecting tank is provided for the working medium from which the feed pump can suck off the working medium and the lubricant.

A further development of the last-mentioned further development comprises the supplying of the working medium from the feed container to the feed pump, the simultaneous suction of a lubricant-poor and a lubricant-rich phase of the working medium from the feed container, or a mixing of a lubricant-poor and a lubricant-rich phase of the working medium in the feed container. Thus, negative effects of a phase separation of the two-phase suspension of working medium and lubricant in the feed container on the operation of the cycle device can be avoided. Such a phase separation (mixture separation) can occur, owing to the density differences, in the feed container after a longer downtime or be caused by a fast separating speed during the operation. This may entail problems, for instance for the start-up, which are overcome by this further development, however. According to a further development the working medium liquefied by the condenser is available in the form of a suspension of working substance and lubricant, wherein in particular no or only a slight dissolution of lubricant in the working substance takes place.

A slight dissolution implies a dissolution of less than 15%, preferably less than 10%, even more preferably less than 5% of lubricant in the working substance. This allows an easy separation of the lubricant from the working substance in the lubricant separator.

Pressurization preferably allows the separated lubricant to flow, in particular directly and/or without pumping, to lubricating points of the expansion machine, in particular to a bearing of the expansion machine; wherein preferably a controlling of a volume flow of the lubricant to the expansion machine is realized. Thus, another pump (oil pump) can be waived, thereby reducing the constructive expenditure and the costs. Controlling the volume flow can be carried out by a flow control valve situated in a conduit between the lubricant separator and the expansion machine.

According to another further development a flow rate of the working medium is reduced in the lubricant separator. This encourages the phase separation of lubricant and working substance.

The method according to the invention may preferably be applied for the lubrication of a volumetrically working expansion machine of an Organic Rankine Cycle (ORC) system. Thus, the working medium can be provided in the form of an organic working substance. For instance, fluorinated hydrocarbons may serve as working substance. While the working substance is typically supplied from the evaporator to the expansion machine substantially in the form of steam, the depleted working medium may contain a portion of lubricant in the liquid state, e.g. in the form of oil droplets which are entrained by the steam of the working substance. The lubricant in the form of oil droplets can be, for instance, a refrigerant oil which, in combination with a working substance, has a miscibility gap (see detailed description below). Suited refrigerant oils are produced, for instance, on a polyalphaolefin basis (PAO, base fluid for lubricants, e.g. Rensio Synth 68 of Fuchs Europe Schmierstoffe GmbH) or an alkylbenzene basis (e.g. Rensio SP 220 of Fuchs Europe Schmierstoffe GmbH).

The aforementioned object is further solved by a thermodynamic cycle device comprising: a working medium including a working substance and a lubricant, an expansion machine, a feed pump for pressurizing the working medium, and a lubricant separator for separating at least a portion of the lubricant from the working medium, wherein the cycle device is adapted to supply at least a portion of the separated lubricant from the lubricant separator to the expansion machine. Advantages of the cycle device according to the invention and the further developments thereof correspond to those that were described in connection with the method according to the invention and the further developments thereof.

The thermodynamic cycle device according to the invention may further comprise: a condenser for liquefying the working medium, and an evaporator for evaporating the working medium depleted of the lubricant, wherein the cycle device is adapted to supply the working medium from the expansion machine to the condenser, to supply the working medium depleted of the lubricant from the lubricant separator to the evaporator, and to supply the evaporated working medium to the expansion machine.

The cycle device may further comprise a feed container, wherein the cycle device is adapted to supply the liquefied working medium from the condenser to the feed container, and to supply the working medium from the feed container to the feed pump.

Furthermore, there may be provided a suction device for sacking in the feed container at least a lubricant-rich phase of the working medium floating at the top, or there may be provided a suction device for simultaneously sucking a lubricant-poor and a lubricant-rich phase of the working medium from the feed container, or there may be provided a mixing device for mixing a lubricant-poor and a lubricant-rich phase of the working medium in the feed container.

The cycle device may be an Organic Rankine Cycle device in which an organic working medium is used, and the expansion machine may be selected from the group consisting of a piston expansion machine, screw expansion machine, a scroll expander, a vane-type machine and a Roots expander.

The lubricant separator may further be adapted to supply at least a portion of the separated lubricant of the expansion machine to respective lubricating points, such as bearings of the expansion machine to be lubricated. According to a further development in particular a conduit may be provided in which the lubricant separated in the lubricant separator is conducted to lubricating points of the expansion machine, in particular to a bearing of the expansion machine; and wherein the conduit may preferably be provided with a flow control valve for controlling the volume flow of the lubricant.

Further provided is a steam power plant, e.g a geothermal steam power plant or a biomass combustion steam power plant, comprising the device according to one of the above examples.

Additional features and exemplary embodiments, as well as advantages of the present invention will be explained in more detail below by means of the drawings. It will be appreciated that the scope of the present invention is not limited to the embodiments. It will further be appreciated that some or all of the features described below may also be combined with each other in another way.

DETAILED DESCRIPTION OF THE INVENTION

Figure 2:
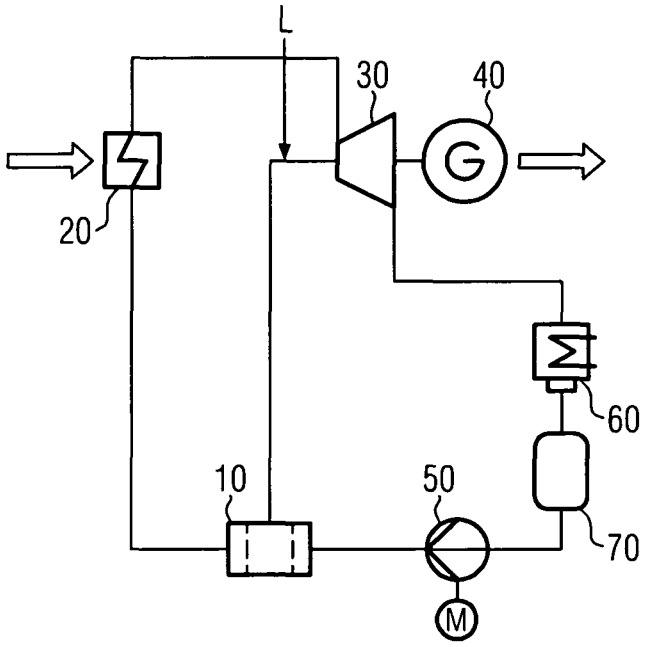
FIG. 2 illustrates by way of example a lubricating system for a volumetric expansion machine according to the present invention.

As shown in FIG. 2, a lubricating system for a volumetric expansion machine in a thermodynamic cycle device according to an example of the present invention comprises a lubricant separator (by way of example referred to as an oil separator below) 10, which is arranged in the cycle between a feed pump 50 and an evaporator 20. The evaporator 20 generates a completely or partially evaporated working medium (live steam) which is suppled to an expansion machine 30 which is driven by the working medium and, in cooperation with a generator 40, serves in the generation of electric energy. The working medium is discharged from the expansion machine 30 in the form of a lubricant-working substance spray and flows to the condenser 60. In the condenser 60 the working medium is liquefied, wherein no or only an insignificant dissolution of lubricant in the working substance should take place. The liquefied working medium is preferably collected in a feed container 70. The feed pump 50 sucks the liquid working medium from the feed container 70, increases the pressure thereof and transports it into the lubricant separator 10. The suspension of lubricant and working substance is brought to live steam pressure. The working medium consists of the actual working substance and a lubricant. The separated lubricant is supplied from the lubricant separator directly, viz. without an additional pump, to the bearing of the expansion machine 30 for the lubrication and cooling thereof. The working medium depleted of lubricant is then resupplied to the evaporator 20, and the cycle is closed.

Figure 1:
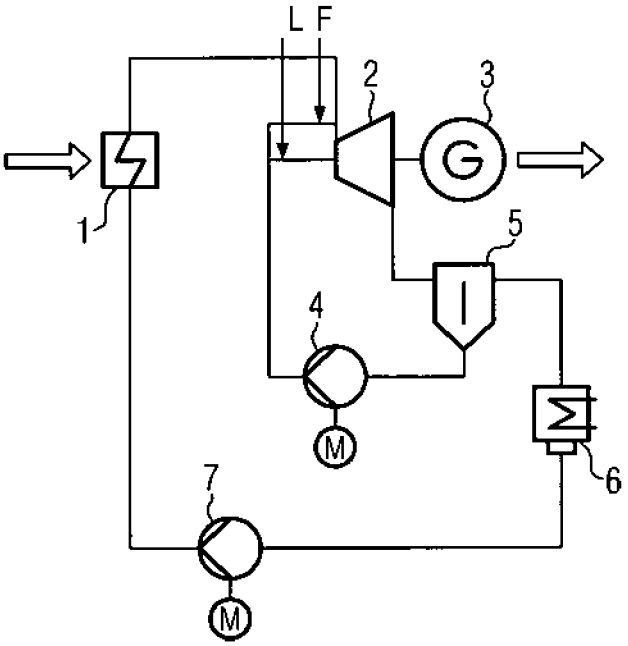
FIG. 1 illustrates a lubricating system for a volumetric expansion machine according to the state of the art.

While in the state of the art the lubricant is separated from the exhaust steam flow, i.e. on the low-pressure side, as was described above with reference to FIG. 1, according to the invention at least a portion of the lubricant is separated from the working medium mixed with the lubricant on the high-pressure side. For separating the lubricant from the working substance, preferably, the different densities of working substance and lubricant are taken advantage of. Internal attachments in the lubricant separator 10 as well as a widened cross-section and a reduction of the flow rate associated therewith encourage the phase separation. As a rule, the lubricant can be discharged in the upper area of the lubricant separator 10. As the discharged lubricant is provided on a high pressure level it may be conducted directly to bearing surfaces of the expansion machine 30, for instance through a conduit.

Owing to the small solubility of oil in the working substance, a portion of the lubricant passes the lubricant separator 10 and is conducted, together with the working substance, to the evaporator 20. Here. too, the lubricant is discharged from the evaporator 20 in a liquid state, but at live steam temperature. The finely distributed lubricant present in the steam ensures a reliable lubrication of the flanks in the expansion machine 30.

The following advantages of the invention should be mentioned. As a liquid is separated at a high density, a compact design of the lubricant separator 10 is obtained. The pressure losses are only insignificant. The lubricant (oil) has the temperature suited for the respective kind of use. Hot oil is used for the lubrication of flanks, and cool oil is used for lubricating and cooling the bearings. The liquid stock, being reduced in comparison with the state of the art, allows a faster start-up of the cycle device. As, according to the example described, the lubricating oil separated in the oil separator 10 is highly pressurized, allowing it to flow freely to the expansion machine 30 on account of the pressure, it is not necessary to provide another pumping device for the lubricant. Advantageously, a pressure reducing valve (flow control valve) may, however, be inserted between the oil separator and the expansion machine, for instance, to correct volume flow fluctuations of the lubricant occurring at different operating points.

As opposed to the state of the art, it is another advantage that a smaller volume flows through the oil separator 10 per unit time so that same can be designed in a comparatively compact manner, resulting in the saving of space and a reduction of costs. In addition, the pressure loss downstream of the expansion machine 30 is reduced so that the pressure difference can be increased by means of the expansion machine 30, as compared with the conventional configuration comprising an oil separator 10 downstream of the expansion machine 30, thus allowing an efficiency increase of the expansion machine 30.

In the constructive implementation of the invention a working medium should be used which has a sufficiently great miscibility gap. This means that an oil-poor phase and an oil-rich liquid phase develop, if, for instance, a pure refrigerant is used and oil is added, same can be dissolved in the working substance up to certain percentage, depending on the temperature. If the oil concentration is increased further, a two-phase mixture is obtained which consists of an oil-poor and an oil-rich liquid phase. If more oil is added a homogenous oil-rich phase is finally obtained.

The working substance may be provided, for instance, in the form of a fluorinated hydrocarbon, e g. R134a, R245fa, and the lubricant in the form of a refrigerant oil. Suited refrigerant oils are produced, for instance, on a polyalphaolefin basis (PAO, base fluid for lubricants, e.g. Rensio Synth 68 of Fuchs Europe Schmierstoffe GmbH) or an alkylbenzene basis (e.g. Rensio SP 220 of Fuchs Europe Schmierstoffe GmbH). In general, the boiling temperature of the lubricant will be clearly higher than that of the working medium so that after passing through the evaporator 20, it will be contained in the working steam of the working medium in a liquid state, in the form of droplets.

Figure 3:
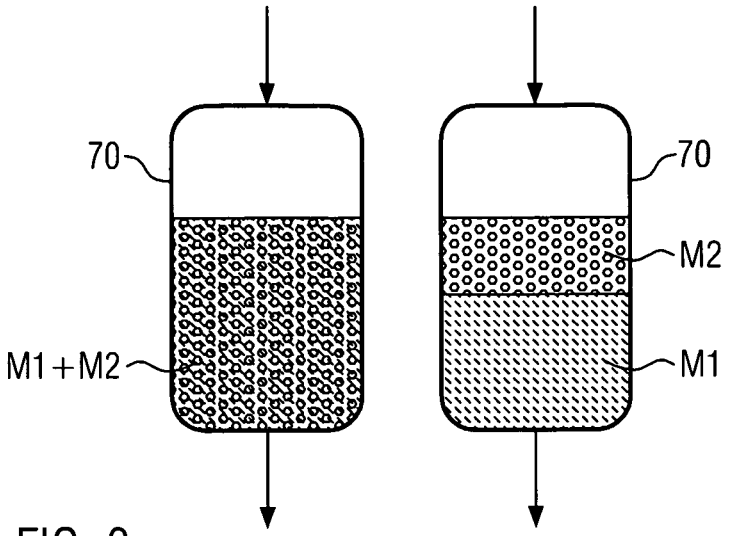
FIG. 3 schematically represents different states of the working medium in the feed container.
Figure 4:
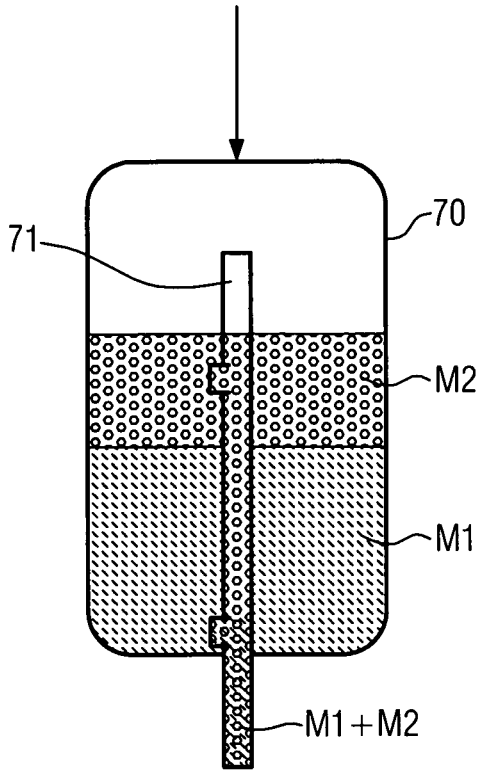
FIG. 4 illustrates a feed container including an suction lance for simultaneously withdrawing an oil-rich and an oil-poor phase.

The start-up of a system in which the two-phase mixture was separated on account of the density differences in the feed container 70, e.g. after a longer standstill, or also owing to a fast separating speed during the operation, is problematical, however. In the right part of FIG. 3 such a phase separation (mixture separation) in the feed container 70 is shown schematically, with M1 designating the oil-poor phase and M2 designating the oil-rich phase, while the left part in FIG. 3 illustrates the two-phase mixture M1~M2 during the operation. In a conventional feed container, as used for instance in refrigerating plants or also in ORC plants, the working medium is withdrawn at the bottom. In the case of a phase separation thus only the oil-poor phase M1 would be supplied to the feed pump. To overcome this problem the feed container may be extended by a suction device 71, e.g. a suction lance, as shown in FIG. 4. The suction lance has for instance, one or more upper and one or more lower bores by means of which the ratio of the volume flows of oil-rich and oil-poor phases can be defined. At the inlet openings of the suction lance exactly that flow rate will be adjusted which compensates the pressure losses in the suction lance. The ratio of the drawn in volume flows can be adjusted by the diameter of the bores and the number and arrangement thereof. In the lower conduit part of the suction lance leading to the feed pump the two phases are mixed, and are separated again from each other in the lubricant separator. If two phases are present the exemplary fixed suction lance 71 draws in same with an adjusting volume ratio.

However, the suction device may also be constructed differently. In a mobile construction, in the presence of two phases, a floater can suck off at least the phase floating at the top. In the presence of two phases a switchable valve can suck off at least the phase floating at the top. The two phases may be mixed by a mixing wheel which is driven by the volume flow, so that in the presence of two phases same are drawn in mixed together. The two phases may also be mixed by a motor-driven mixing wheel so that, if two phases are provided same are drawn in mixed together.

Summarizing, the invention relates to a device and a method for separating lubricant from the liquid working medium. To this end, a working medium-oil pairing is used in which the mutual dissolution of the oil and working medium is only insignificant. Therefore, the oil in a lubricant separator can be discharged for the lubrication and cooling of bearings in an expansion machine. As a mixture separation may occur in the feed container the device has to ensure that, in this case, both phases are drawn in, which may be realized, for instance, by a suction lance.

The invention claimed is:

1. Method for lubricating an expansion machine in a thermodynamic cycle device, wherein the cycle device comprises the expansion machine, a feed pump, a lubricant separator and a working medium including a working substance and a lubricant, and wherein the method comprises the following steps:

pressurizing the working medium by the feed pump;

supplying the pressurized working medium from the feed pump to the lubricant separator;

separating lubricant from the working medium by the lubricant separator; and supplying at least a portion of the separated lubricant from the lubricant separator to the expansion machine;

wherein the cycle device further comprises a condenser and an evaporator, and wherein the method further comprises the following steps:

supplying the working medium from the expansion machine to the condenser;

liquefying the working medium by the condenser;

supplying the liquefied working medium from the condenser to the feed pump;

supplying the working medium depleted of the lubricant from the lubricant separator to the evaporator;

evaporating the working medium depleted of the lubricant in the evaporator; and supplying the evaporated working medium to the expansion machine;

wherein only a portion of the lubricant is separated by the lubricant separator, such that lubricant remaining in the working medium depleted of the lubricant serves in the lubrication of parts of a working chamber of the volumetrically working expansion machine that roll upon or glide along one another.

2. The method according to claim 1, wherein the cycle device further comprises a feed container, and wherein the step of supplying the liquefied working medium from the condenser to the feed pump comprises the sub-steps of (i) supplying the liquefied working medium from the condenser to the feed container, and (ii) supplying the working medium from the feed container to the feed pump.

3. The method according to claim 2, wherein the supplying of the working medium from the feed container to the feed pump comprises the simultaneous suction of a lubricant-poor and a lubricant-rich phase of the working medium from the feed container, or a mixing of a lubricant-poor and a lubricant-rich phase of the working medium in the feed container.

4. The method according to claim 1, wherein the working medium liquefied by the condenser is available in the form of a suspension of working substance and lubricant.

5. The method according to claim 1, wherein on account of the pressurization, the separated lubricant flows to lubricating points of the expansion machine.

6. The method according to claim 1, comprising the further step: reducing a flow rate of the working medium in the lubricant separator.

7. The method according to claim 1, in which the working substance is provided in the form of an organic working substance.

8. The method according to claim 1, wherein no or only a slight dissolution of less than 15% of lubricant in the working substance takes place.

9. The method according to claim 1, wherein the separated lubricant flows to a bearing of the expansion machine, and wherein a controlling of a volume flow of the lubricant to the expansion machine is realized.

10. The method according to claim 1, wherein the working medium comprises a fluorinated hydrocarbon or is made thereof and/or the lubricant comprises a refrigerant oil or is made thereof.

11. Thermodynamic cycle device comprising:

a working medium including a working substance and a lubricant;

an expansion machine;

a feed pump for pressurizing the working medium; and a lubricant separator for separating at least a portion of the lubricant from the working medium;

wherein the cycle device is adapted to supply at least a portion of the separated lubricant from the lubricant separator to the expansion machine;

the cycle device further comprising:

a condenser for liquefying the working medium; and an evaporator for evaporating the working medium depleted of the lubricant;

wherein the cycle device is adapted to supply the working medium from the expansion machine to the condenser, to supply the working medium depleted of the lubricant from the lubricant separator to the evaporator, and to supply the evaporated working medium to the expansion machine;

wherein the lubricant separator is configured to separate only a portion of the lubricant, such that lubricant remaining in the working medium depleted of the lubricant serves in the lubrication of parts of a working chamber of the volumetrically working expansion machine that roll upon or glide along one another.

12. The cycle device according to claim 11, in which the cycle device further comprises a feed container, and wherein the cycle device is adapted to supply the liquefied working medium from the condenser to the feed container, and to supply the working medium from the feed container to the feed pump.

13. The cycle device according to claim 12, wherein a suction device is provided for sucking in the feed container at least a lubricant-rich phase of the working medium floating at the top, or wherein a suction device is provided for simultaneously sucking a lubricant-poor and a lubricant-rich phase of the working medium from the feed container, or wherein a mixing device is provided for mixing a lubricant-poor and a lubricant-rich phase of the working medium in the feed container.

14. The cycle device according to claim 11, in which the cycle device is an Organic Rankine Cycle device and/or in which the expansion machine is selected from the group consisting of a piston expansion machine, screw expansion machine, a scroll expander, a vane-type machine and a Roots expander.

15. The cycle device according to claim 11, further comprising a conduit in which the lubricant separated in the lubricant separator is conducted to lubricating points of the expansion machine.

16. Steam power plant comprising the device according to claim 11.

17. The cycle device according to claim 11, wherein the lubricant separated in the lubricant separator is conducted to a bearing of the expansion machine.

* * * * *